United States Patent [19]

Miller

[11] Patent Number: 4,920,852

[45] Date of Patent: May 1, 1990

[54] PORTABLE, SELF-CONTAINED EXPLOSIVES SYSTEM

[75] Inventor: Kenneth A. Miller, West Jordan, Utah

[73] Assignee: Ireco Incorporated, Salt Lake City, Utah

[21] Appl. No.: 334,807

[22] Filed: Apr. 7, 1989

Related U.S. Application Data

[63] Continuation-in-part of Ser. No. 192,868, May 10, 1988, abandoned.

[51] Int. Cl.[5] ..... C06B 21/00; F42B 3/00

[52] U.S. Cl. ..... 86/1.1; 102/315; 102/323; 102/324; 102/705

[58] Field of Search ..... 102/331, 323, 315, 316, 102/324, 705; 86/1.1

[56] References Cited

U.S. PATENT DOCUMENTS

| | | | |
|---|---|---|---|
| 3,153,531 | 10/1964 | Cook | 222/136 |
| 3,719,144 | 3/1973 | Tlam | 102/331 |
| 3,750,527 | 8/1973 | Heinemann | 86/1.1 |
| 3,768,410 | 10/1973 | Maes et al. | 149/36 |
| 3,768,411 | 10/1973 | Maes et al. | 102/315 |
| 3,815,501 | 6/1974 | Anderson et al. | 102/315 |
| 3,832,950 | 9/1974 | Hurst | 102/323 |
| 3,926,119 | 12/1975 | Hurst et al. | 102/323 |
| 4,000,696 | 1/1977 | Friant et al. | 102/315 |
| 4,006,687 | 2/1977 | Ridgeway | 102/315 |

OTHER PUBLICATIONS

Advertising literature of Semco Division, Products Research & Chemical Corporation, apparent owner of foregoing patent.

*Primary Examiner*—Howard J. Locker

[57] ABSTRACT

The present invention relates to a system for forming an explosive and more particularly to a system that is portable, self-contained and is capable of mixing essentially non-explosive ingredients from separate containers or separate compartments within a container to form an explosive. The system is particularly adaptable for military or tactical applications.

23 Claims, 1 Drawing Sheet

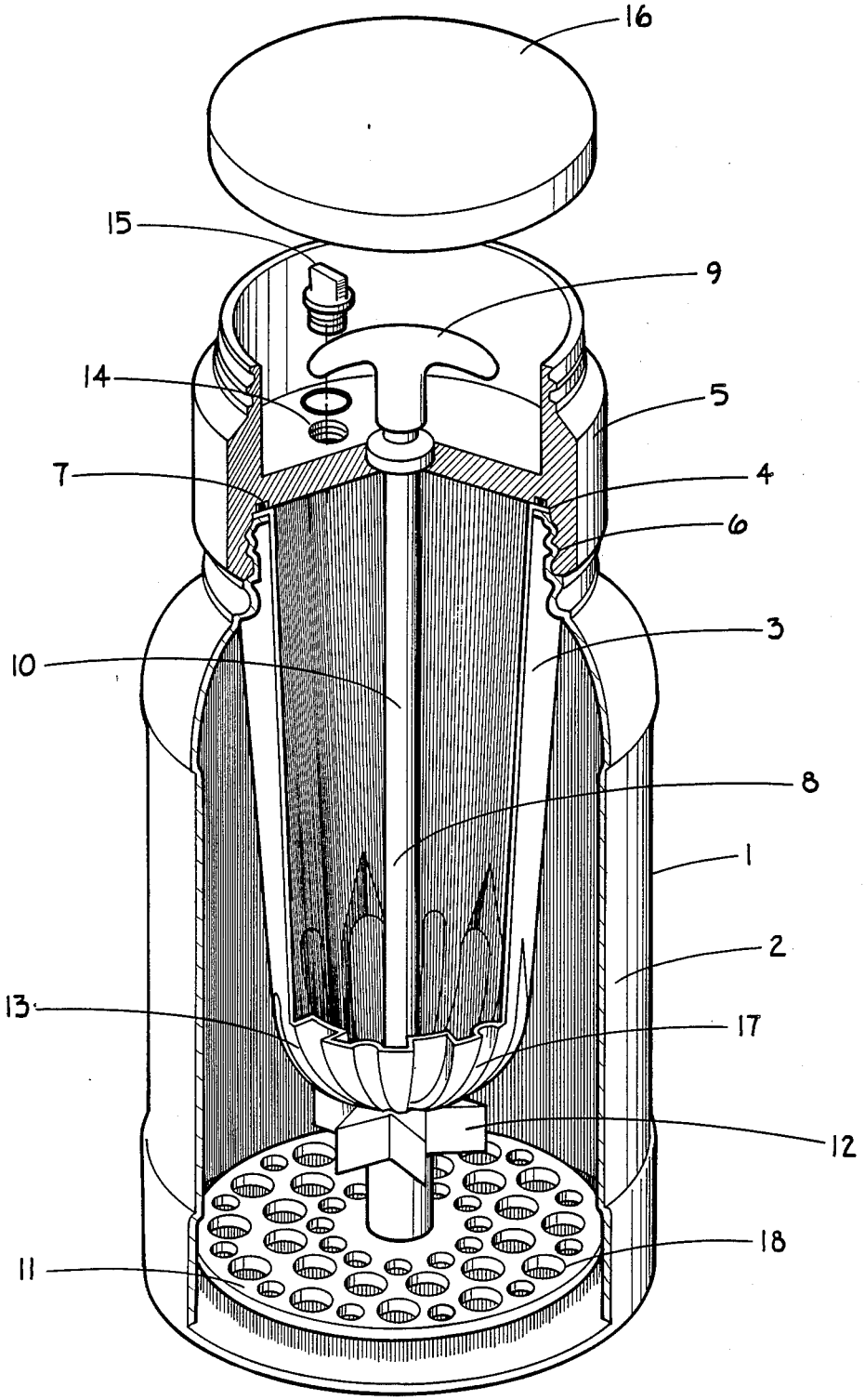
16
15
9
14
5
7
4
6
3
10
8
1
2
13
17
12
18
11

PORTABLE, SELF-CONTAINED EXPLOSIVES SYSTEM

This application is a continuation-in-part of application Ser. No. 192,868, filed May 10, 1988, now abandoned.

BACKGROUND OF THE INVENTION

The present invention relates to a system for forming an explosive and more particularly to a system that is portable, self-contained and is capable of mixing essentially non-explosive ingredients from separate containers or separate compartments within a container to form an explosive. The system is particularly adaptable for military or tactical applications.

Common uses for explosives in military or tactical applications are for demolition work, barrier creation, concrete breaching, concertina wire removal, etc. It often is necessary for infantry to carry explosives on their persons for such purposes. This creates a hazard for the person carrying the explosive as well as for those in the person's vicinity, because the explosive, which necessarily must be relatively sensitive to initiation in small quantity applications, may be susceptible to initiation by rifle bullet or other projectile or munition. A need therefore exists for a tactical explosive that can be carried by infantry in a non-explosive state and then rendered detonable at the desired time. This need is satisfied by the system and unit of the present invention which houses segregated non-explosive ingredients that can be readily mixed together at the intended time of usage to form a sensitive, detonable explosive.

In addition, a tactical explosive for infantry use must be capable of being transported in a backpack, must be able to be used with minimal preparation time and must be capable of use in varied weather and battle conditions. The system and unit of the present invention satisfy these requirements in that the unit can be sized to fit in a backpack; the self-contained unit readily can form an explosive within, for example, one minute; the mixing operation can be accomplished manually without any direct contact with the ingredients or the final explosive; the containers protect the ingredients from the environment; an inner container is housed within an outer container and thus the handling of separate containers is not required; the unit can be operated under water and the explosive composition itself can be designed to be flowable and waterproof thereby making it adaptable for a variety of applications.

Finally, a tactical explosive must be capable of producing sufficient energy and brisance to accomplish its intended purpose. Heretofore, a relatively powerful compound explosive has been used such as TNT (trinitrotoluene), Composition B, pressed RDX and C4. As explained more fully hereafter, the system of the present invention is capable of forming an explosive of equal or greater energy and brisance than such compound explosives but which is formed from non-detonable ingredients that can be transported safely.

SUMMARY OF THE INVENTION

The system comprises an outer container for holding one or more ingredients of the explosive, an inner container for holding one or more ingredients of the explosive and a mixing element for mixing together the ingredients from the two containers to form an explosive. Preferably, the inner container is rupturable by engagement of the mixing element, which can be manually operated in a reciprocal or other fashion to mix the ingredients uniformly together. The invention also relates to a unit comprising the containers and mixing element. Preferably, one container holds an inorganic oxidizer salt solution and the other a fuel. When these ingredients are mixed together an explosive is formed from preferably non-explosive ingredients.

BRIEF DESCRIPTION OF THE DRAWING

The FIGURE shows a perspective, partially cut-away view of a portable, self-contained explosives mixing unit constructed in accordance with the present invention.

FIG. 2 shows a perspective, cut-away view of a preferred embodiment of the present invention.

DETAILED DESCRIPTION

Referring to the FIGURE, there is shown one illustrative embodiment of a portable, self-contained explosives mixing unit 1 constructed in accordance with the present invention and including a first or outer container 2 for holding one or more ingredients of the explosive. This outer container preferably is rigid or semi-rigid and can be formed from any material compatible with the contained ingredients, such as plastic. Housed or disposed within the outer container 2 is an inner or second container 3 for holding one or more additional ingredients of the explosive which when mixed with the ingredient(s) in the outer container 2 will form an explosive. The inner container 3 has at its open end a flange 4 that abutts or sets upon a corresponding surface at the top of the outer container 1. The flange 4 is secured against the outer container 2 by means of a cap 5 that is threadibly engaged with outer container 1 by threads 6. The flange 4 is sealed with respect to the cap 5 by means of an o-ring 7. (A similar o-ring seal could be placed between the flange and the adjacent surface of the outer container or the flange could be glued to such surface.) In this fashion, the ingredients within the inner container are segregated from the ingredients in the outer container.

The inner container 3 is composed of a material that is rupturable or frangible to allow mixing of the ingredients in the inner container with those in the outer container at the desired time. Such frangible materials include polystyrene or other plastics. The cap 5 also could function as an inner container if, for example, inner container 3 were an integral part of cap 5 or if cap 5 otherwise were modified to hold ingredients that were separated from the ingredients in the outer container by means of a rupturable membrane. Thus the language "housed or disposed within" includes configurations in which the inner container is adjacent to the outer container and separated therefrom by a rupturable membrane.

Slidably engaged with the cap 5 is a mixing element or plunger 8 in the form of a rod and piston assembly having a handle 9, a shaft 10, a baffle plate 11 at the end of the shaft opposite the handle and a base 12 disposed on the shaft 10 between the baffle plate 11 and the closed end 13 of the inner container 3. The shaft 10 extends through the axis of the inner container 3 and protrudes through its closed end 13.

Also shown is a port 14, through which ingredients may be loaded into the inner container 3 or through which a blasting cap may be inserted, and plug 15. A lid 16 is adapted to be removably engaged with the cap 5 to cover and prevent premature movement of the plunger 8.

Once the unit 1 is assembled as shown in the FIGURE with the separate explosive ingredients present in both the inner and outer containers, the unit can be operated to mix the ingredients together and produce an explosive as follows. The lid 16 first is removed and then the handle 9 of the plunger 8 manually is pulled or forced upward or away from the cap 5 and outer container 1. This causes the base 12 of the plunger to put a compressive force on the closed end 13 of the frangible inner container 3, and as the plunger 8 is continued to be pulled toward the top or opening of the outer container 1, the frangible inner container ruptures or breaks and the ingredients thereof are allowed to mix with those ingredients in the outer container. The closed end 13 of the inner container can have grooves or convolutions 17 as shown to ease or enhance the rupturing of the inner container. As the plunger then is forced to reciprocate within the confines of the outer container 1, the baffle plate 11 moves up and down (or back and forth) along the axis of the outer container 1, much like a piston within a cylinder, to mix uniformly the ingredients in the ruptured inner container with those in the outer container. The orifices 18 in the baffle plate 11 enhance this mixing action as the ingredients are forced to flow through the orifices. The ruptured or broken inner container 3 may break apart into several or more separate pieces which also enhance the mixing action, and it has been found that the presence of separate pieces of inner container 3 does not adversely affect the detonation results of the final mixed explosive.

The embodiment or mixing unit 18, comprises a single container 19 for holding the ingredients of the explosive. The internal volume of the container is defined by a top lid 20 and a bottom lid 21. Top lid 20 is secured to container 18 by retaining rings 23 and contains an o-ring seal 22.

A plunger 24 having a handle 28 and a shaft 29 is slidably engaged to top lid 20 and threadably engagable to bottom lid 21. Affixed to the end of the plunger 24 opposite handle 28 is a baffle plate 25 having openings 26 and spikes 27. A rupturable membrane 30 is circumferentially sealed to flange 31 and hub 38. Flange 31 is slidably sealed to container 19 by lip seals 39. Disposed between the boundaries of the membrane 30 and the top lid 20 are one or more ingredients of the explosive (not shown). Also disposed between the membrane 30 and the bottom lid 21 are one or more additional ingredients of the explosive. In this manner, the respective ingredients are kept separate within container 18.

Slidably attached to shaft 29 and held flush to baffle plate 34 by hub 38 is a spring clip 32 that will engage into groove 33 during the upward stroke of the plunger. Once spring clip 32 is engaged into groove 33, baffle plate 25 and baffle plate 34 will move in unison and in proximity during reciprocation of plunger 24.

The embodiment in FIG. 2 is operated as follows. As the handle 28 is pulled upwardly, the baffle plate 25 also moves upwardly in unison with the handle and eventually the spikes 27 rupture the membrane 30. The handle 28 can be rotated to cause the spikes 27 to rip or tear the membrane 30 further. When the groove 33 reaches the spring clip 32, the spring clip 32 will affix the baffle plate 25 adjacent to the flange 31. As the plunger 24 is pushed downwardly to its initial position, flange 31 is forced toward the bottom lid 21 where it remains during the mixing action. Upon reciprocation of the plunger 24, the baffle plates 34 and 25 will reciprocate in unison and cause the ingredients within the container 18 to mix uniformly to form an explosive. When mixing of the ingredients is completed, the explosive product can be poured through ports 35 or 36, if desired.

A cap well 40 can receive a blasting cap for initiating the mixed explosive within the container, if desired. A through hole 41 can receive detonating cord as another initiating means.

A further embodiment of the present invention would comprise an outer container similar to that shown in FIG. 2, but instead of a membrane to separate the ingredients, a sealed pouch containing one or more ingredients would be disposed within the liquid ingredients phase in the container. The pouch would be rupturable by the action or movement of the plunger.

The present invention can be further illustrated by reference to the examples given below.

In a unit similar in construction to that shown in the FIGURE, explosive compositions were formed under various conditions and were test detonated as follows:

Formulation (parts by weight of the final composition):

| Oxidizer Solution (outer container) | | Fuel (inner container) | |
|---|---|---|---|
| Sodium perchlorate | 40.5 | Atmoized aluminum | 18.0 |
| Water | 31.0 | Paint grade aluminum | 2.0 |
| Ethylene glycol | 8.0 | | 20.0 |
| Xanthan gum | .5 | | |
| | 80.0 | | |

Testing Results:

| Mix | 1 | 2 | 3 | 4 | 5 |
|---|---|---|---|---|---|
| Mixing Temp (°C.) | 25 | 25 | 25 | 25 | −10 |
| Mixing Strokes | 20 | 150 | 50 | 50 | 50 |
| Density (g/cc) | 1.365 | 1.356 | 1.360 | — | — |
| Detonation Temp (°C.) | 25 | 25 | −10 | 25 | −10 |
| D-150 mm (km/sec)[1] | | | | 4.54 | |
| -125 | | | | 4.54 | |
| -100 | | | | 4.38 | |
| -75 | 4.23 | 4.10 | 4.38 | 4.23 | 4.23 |
| -63 | — | — | — | 3.97 | — |
| -50 | — | — | — | 3.74 | — |
| -38 | — | — | — | 3.34 | — |
| -32 | — | — | — | 3.43 | — |
| -25 | — | — | — | 3.26 | — |
| -19 | — | — | — | 2.20 | — |
| -12 | — | — | — | Fail | — |
| MB-det/fail (cap#)[2] | I2/I1 | I3/I2 | I3/I2 | I1/- | I4/I3 |
| 1 Cloth Wrap* 2 50 grain Cord Wraps | — | — | Det[3] | — | — |
| 1 Cloth Wrap* 1 50 gr. Cord Wrap | — | — | Det | — | — |
| 3 Cloth Wraps* 1 50 gr. Cord Wrap | — | — | Det | — | — |
| Bullet Impact @ 25° C. (22/.250) with Steel backing plate | — | — | Fail[4] | — | — |

*A plastic bottle (4.5 inches in diameter) was filled with the mixed explosive. A heavy canvas cloth was wrapped around bottle, and detonating cord was wrapped around the cloth.

[1]Detonation velocity in the given charge diameter at the given temperature.

[2]Minimum booster in a 75 mm charge at the given temperature. The left number indicates that a detonation occurred with the designated cap and the right number indicates a failure. I1 is a blasting cap having 1 grain of loose PETN; I2, I3 and I4 have 2, 3 and 4 grains, respectively.

[3]Charge detonated.

[4]Charge failed to detonate.

In the above example, the inner container was a rigid polystyrene plastic which was ruptured and broken into several pieces upon engagement of the mixing element (plunger comprising a handle, shaft and baffle plate). The outer container was polyethylene, the plunger assembly or mixing element was comprised of a polycarbonate shaft and base, and the baffle plate was a high density polyethylene. The cap element, similar in configuration to cap (5) shown in the FIGURE, was comprised of high density polyethylene, and the lid (16) was medium density polyethylene. The inner container contained 1000 grams of the atomized and paint grade aluminum mixture and the outer container contained 3545 grams of the sodium perchlorate solution, which occupied about 2.36 liters of the 3.79 liter capacity of the outer container. The mixing strokes were done manually and each stroke occurred in less than 1 second. Thus all mixes except Mix 2 were formed in less than 1 minute. As indicated in the detonation results, all of the mixes were relatively sensitive to detonation even at a temperature of −10° C.

The mixing was accomplished by an individual who held the outer container on the ground with one hand while he reciprocated the plunger assembly with the other hand. Following completion of the indicated number of strokes, the resulting mixed explosive was poured into the various charge diameters and plastic bottles for detonation testing.

As shown in the preceding example, explosive compositions for use with the system and in the unit preferably are formed from a binary system of oxidizer and fuel, with the oxidizer in one container and the fuel in the other. The oxidizer component preferably is a solution of inorganic oxidizer salt selected from the group consisting of ammonium, alkali and alkaline earth metal nitrates, chlorates and perchlorates or mixtures thereof. Perchlorates are particularly preferred because they increase density and enhance sensitivity in explosive compositions of this type.

The fuel component can be a liquid, a solid or combinations thereof. The fuel used in the above example was a mixture of aluminum particles, with the paint grade aluminum acting as both a fuel and a sensitizer. Other solid fuels include finely divided carbonaceous materials such as gilsonite, finely divided vegetable grains such as wheat and potato starch, and sulfur. Liquid fuels include water-immiscible organic liquids such as mineral oil, waxes, paraffin oils, benzene, toluene, xylenes and petroleum distillates. Water-miscible organic liquids that can be used as fuels include alcohols such as methyl alcohol, glycols such as ethylene glycol, amides such as formamide, and analogous nitrogen-containing liquids. As shown in the example, a portion of the fuel (ethylene glycol) was contained in the oxidizer solution component, because ethylene glycol is a solvent for the oxidizer and as a liquid was easier to handle in the solution rather than in the dry (aluminum) component.

Water preferably is present in sufficient quantity to keep the oxidizer salt in solution at intended temperatures of use to allow for a fluid mixing medium. The xanthan gum thickening agent in the oxidizer solution renders the solution more viscous which aids in suspending the aluminum particles uniformly throughout the composition following mixing. Various thickening agents are well-known in the art. A density reducing agent, such as hollow glass or plastic spheres, may be included in either the oxidizer or fuel component to increase sensitivity.

The theoretically available energy of the formulation of the example is 1384 kcal/kg, which compares favorably with that for TNT of 1235 kcal/kg.

Although in the above example the oxidizer solution was in the outer container, and the aluminum fuel was in the inner container, this arrangement could have been reversed; however, it was easier to mix the solids into the liquid.

A preferred size of the unit of the present invention is as follows: An outer container capable of holding 4545 grams of mixed explosive and comprising a cylindrical container approximately 15 centimeters in diameter and 20 centimeters in height. The inner container would be about one-fourth of this size (if holding the fuel component). The size of the unit and its various components, however, can be varied as desired.

The explosive should be fluid at the mixing temperature for ease of mixing and to allow ease of removal from the outer container into a separate receptacle, if desired. Further, a fluid explosive can be used advantageously in a variety of applications.

The positioning of the inner container within the outer container is not critical; however, if the inner container is axially positioned within the outer container, then uniformity of the final mixture is somehwat easier to obtain. By using a rigid but frangible inner container, the two ingredient components (oxidizer and fuel) can be spatially positioned relative to each other and to the mixing element to enhance uniformity of mixing and ease of rupturing of the inner container. The concept of housing an inner container within an outer container is advantageous in that it dispenses with the need to handle separate containers. This prevents the possibility of separation or misplacement of one of the containers, does not require the handling of separate containers (which is time consuming and difficult if not impossible to accomplish under water) and prevents potential errors in attempting to combine ingredients from separate containers.

What is claimed is:

1. A portable self-contained unit for transporting and mixing ingredients to form a fluid explosive comprising:

(a) an outer container for holding an ingredient comprising an inorganic oxidizer salt solution, (b) an inner container disposed within the outer container for holding an ingredient comprising a fuel component, which when mixed with the ingredient(s) in the outer container forms an explosive, and (c) a mixing element for mixing together by mechanical agitation the ingredients in the outer and inner containers to form an explosive.

2. A unit according to claim 1 wherein the inner container is rupturable by the mixing element upon its engagement.

3. A unit according to claim 1 wherein the mixing element comprises a manually operable reciprocating plunger.

4. A unit according to claim 3 wherein the plunger is adapted to rupture the inner container when caused to reciprocate and to mix uniformly the ingredient(s) in the ruptured inner container with the ingredient(s) in the outer container to form an explosive.

5. A unit according to claim 1 wherein the fuel is selected from the group consisting of aluminum particles, carbonaceous materials, finely divided vegetable grains, sulfur and mixtures thereof.

6. A unit according to claim 1 wherein at least one of the ingredients in the other container is a sensitizer.

7. A unit according to claim 6 wherein the sensitizer is selected from the group consisting of compound explosives, particulate metals, density reducing agents and mixtures thereof.

8. A unit according to claim 3 wherein the plunger comprises a rod and piston assembly and the piston is in the form of a baffle plate.

9. A unit according claim 8 wherein the baffle plate has one or more orifices through which at least part of the ingredients are forced to flow as the plunger reciprocates.

10. A portable, self-contained system for manufacturing a fluid explosive comprising ingredients of the explosive and further comprising:

(a) a first container holding an ingredient comprising an inorganic oxidizer salt solution, (b) a second container disposed within the first container and holding an ingredient comprising a fuel component, and (c) a means for rupturing the second container, and (d) a mixing element adapted to rupture the second container and to mix by mechanical agitation the ingredient(s) of the second container with the ingredient(s) of the first container to form the explosive.

11. A system according to claim 10 wherein the mixing element comprises a rod and piston assembly and the piston is in the form of a baffle plate.

12. A system according to claim 11 wherein the baffle plate has one or more orifices through which at least part of the ingredients are forced to flow as the mixing element reciprocates.

13. A system according to claim 10 wherein the inorganic oxidizer salt solution comprises water and salt selected from the group consisting of ammonium, alkali and alkaline earth metal nitrates, chlorates and perchlorates or mixtures thereof and the fuel is selected from the group consisting of solid fuels and liquid fuels.

14. A system according to claim 13 wherein the inorganic oxidizer solution comprises a solution of sodium perchlorate and the fuel comprises aluminum particles.

15. A portable, self-contained unit for transporting and mixing ingredients to form a fluid explosive comprising:

(a) a container for holding the ingredients which comprise an inorganic oxidizer salt solution and a fuel component, (b) a rupturable membrane having opposite sides and disposed within the container so as to separate the oxidizer salt solution on one side of the membrane from the fuel component on the other side of the membrane, (c) a means for rupturing the membrane, and (d) a mixing element for mixing together by mechanical agitation all of the ingredients of the container to form an explosive.

16. A unit according to claim 15 wherein the membrane is rupturable by the mixing element upon its engagement.

17. A unit according to claim 15 wherein the mixing element comprises a manually operable reciprocating plunger.

18. A unit according to claim 17 wherein the plunger is adapted to rupture the membrane when caused to reciprocate and to mix uniformly the ingredients in the container to form an explosive.

19. A portable, self-contained system for manufacturing a fluid explosive comprising the ingredients of the explosive and further comprising:

(a) a container holding the ingredients of the explosive, which comprise an oxidizer salt solution and a fuel component (b) a rupturable membrane having opposite sides and disposed within the container so as to separate the oxidizer salt solution on one side of the membrane from the fuel component on the other side of the membrane, (c) a means for rupturing the membrane, and (d) a mixing element adapted to mix by mechanical agitation the ingredients to form the explosive.

20. A system according to claim 19 wherein the inorganic oxidizer salt solution comprises water and salt selected from the group consisting of ammonium, alkali and alkaline earth metal nitrates, chlorates and perchlorates and mixtures thereof and the fuel is selected from the group consisting of solid fuels and liquid fuels.

21. A system according to claim 20 wherein the inorganic oxidizer solution comprises a solution of sodium perchlorate and the fuel comprises aluminum particles.

22. A system according to claim 19 wherein the mixing element comprises a rod and piston assembly and the piston is in the form of a baffle plate.

23. A system according to claim 22 wherein the baffle plate has one or more orifices through which at least part of the ingredients are forced to flow as the mixing element reciprocates.

* * * * *